US006266493B1

(12) United States Patent
Farrell et al.

(10) Patent No.: US 6,266,493 B1
(45) Date of Patent: Jul. 24, 2001

(54) PRINTING SYSTEMS AND METHODS

(75) Inventors: Michael E. Farrell, Ontario, NY (US); Leslie E. Waggett, Ft. Pierce, FL (US); David C. Robinson; Louis O. Pepin, both of Penfield, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/560,912

(22) Filed: Apr. 28, 2000

(51) Int. Cl.[7] ..... G03G 15/00

(52) U.S. Cl. ..... 399/24; 358/1.13; 399/23; 399/27; 399/28; 399/82

(58) Field of Search ..... 399/24, 27, 28, 399/82, 23; 358/1.13, 1.14, 1.1

(56) References Cited

U.S. PATENT DOCUMENTS 5,036,361 * 7/1991 Filion et al. .
5,383,129 * 1/1995 Farrell .
5,881,337 * 3/1999 Higashikawa et al. ..... 399/82
6,027,200 * 2/2000 Takahashi et al. ..... 399/27 X

FOREIGN PATENT DOCUMENTS 62-3267 * 1/1987 (JP) .
1-127769 * 10/1989 (JP) .
6-138739 * 5/1994 (JP) .
8-152824 * 6/1996 (JP) .

* cited by examiner

*Primary Examiner*—Susan S. Y. Lee
(74) *Attorney, Agent, or Firm*—McIntyre Harbin & King

(57) ABSTRACT

A printing machine that records information about resources expended to carry out a printing request. The recorded resource information may include quantities of particular paper types and colored toner needed to satisfy the printing request. Subsequently, before carrying out another printing request, the printing machine uses the recorded information to make a prediction or estimate of resources required to carry out the printing request. The printing machine thus reduces uncertainty about whether there are sufficient resources to satisfy the next request, and alleviates the burden of maintaining excessive consumables in inventory.

48 Claims, 12 Drawing Sheets

2

PRINTING SYSTEMS AND METHODS

BACKGROUND OF THE INVENTION

This invention relates generally to a printing system and, more particularly, to a printing system that stores image data for reprinting at a later time.

Printing devices may be inefficient users of consumable resources such as paper, ink, and fuser agent. Waste may result from scrap prints created during the set-up of the devices, or purged prints after paper jams or other malfunctions. Further, a customer may reject some prints as being poor image quality or finishing quality.

Another source of waste may be deliberate overprints to allow for loss during post-print processing, notably finishing.

Operators of production devices may have no method to accurately determine the quantity of consumables needed to re-print a job. Thus, operators, lacking methods of monitoring whether they will have sufficient consumables, may order excessive consumables.

The following document may be relevant to the instant disclosure: U.S. Pat. No. 5,383,129 issued Jan. 17, 1995 to Farrell.

SUMMARY OF THE INVENTION

It is an object of the present invention to provide printing systems and methods that address the problems described above.

To achieve this and other objects of the present invention, a method comprises generating a first signal indicating a quantity of a first set of printed documents; generating a second signal indicating a quantity of a resource consumed in producing the quantity of the first set; storing the first and second signals; receiving a third signal indicating a desired quantity of a second set; and estimating a quantity of the resource needed to effect the desired quantity of the second set, the estimating depending on the first, second, and third signals.

According to another aspect of the present invention, a system comprises a generator that generates an associating signal associating a first signal indicating a quantity of a first set of printed documents, with a second signal indicating a quantity of a resource consumed in producing the quantity of the first set; a memory that stores the associating signal; receiver that receives a third signal indicating a desired quantity of a second set; and an estimator that estimates a quantity of the resource needed to effect the desired quantity of the second set, the estimating depending on the first, second, and third signals.

According to yet another aspect of the present invention, a system comprises means for receiving first signal indicating a quantity of a first set of printed documents; means for generating a second signal indicating a quantity of a resource consumed in producing the quantity of the first set; means for storing the first and second signals; means for receiving a third signal indicating a desired quantity of a second set; and means for estimating a quantity of the resource needed to effect the desired quantity of the second set, the estimating depending on the first, second, and third signals.

The accompanying drawings which are incorporated in and which constitute a part of this specification, illustrate embodiments of the invention and, together with the description, explain the principles and advantages of the invention. Throughout the drawings, corresponding parts are labeled with corresponding reference numbers.

DESCRIPTION OF THE PREFERRED EMBODIMENTS

Figure 1:
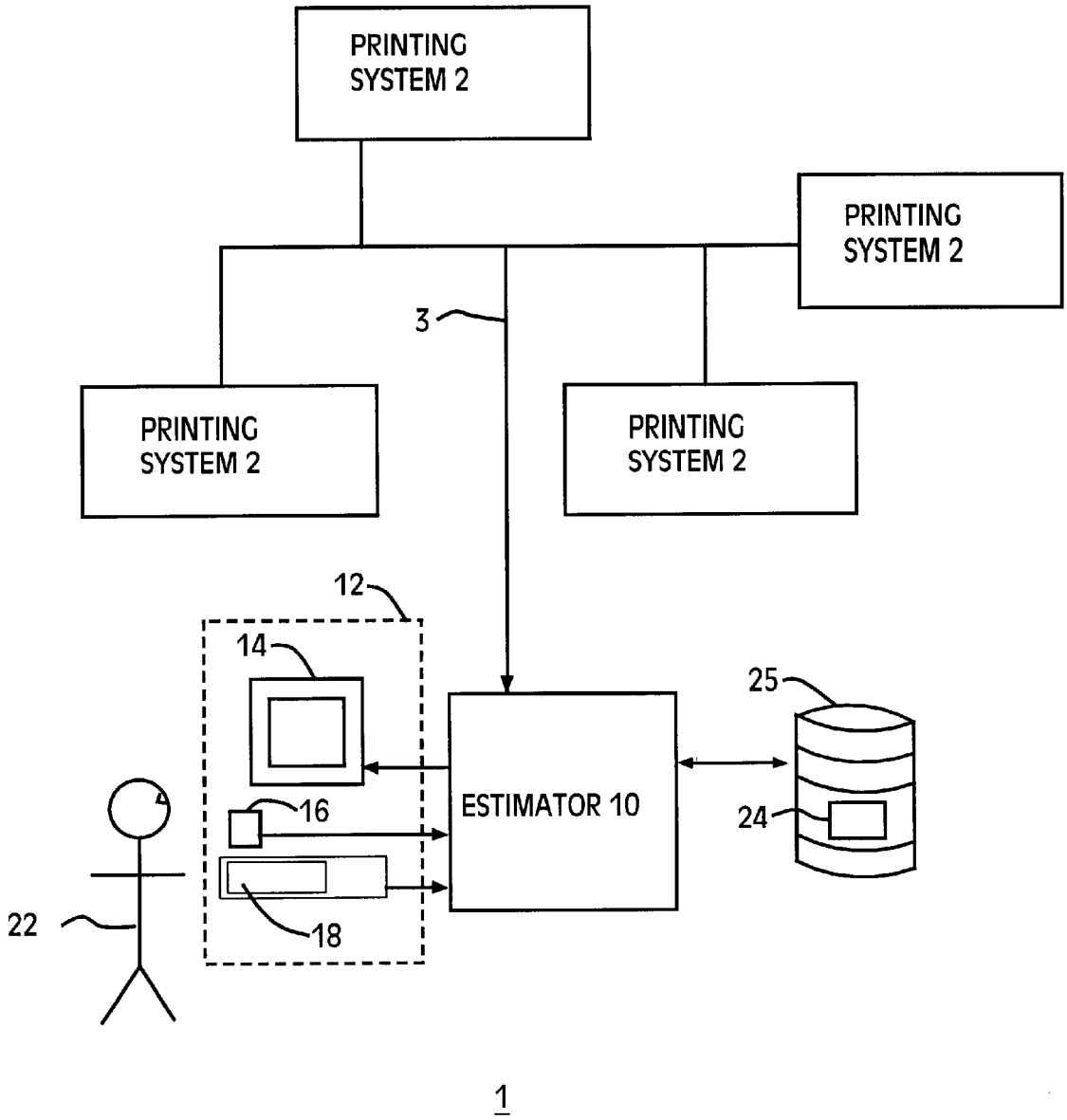
FIG. 1 is an overview of a printing system in accordance with a preferred embodiment the present invention.

FIG. 1 shows a printing system 1 in accordance with a preferred embodiment of the present invention. System 1 includes multiple printing systems 2 that send data to an estimator 10 via LAN cable 3. Estimator 10 is a program invokable by a user at one of the printing systems 2, or by user 22 at user terminal 12. Terminal 12 includes CRT 14, mouse pointing device 16, and keyboard 18.

Estimator 10 writes to and reads from database 24 stored on magnetic disk memory 25. Estimator 10 includes a memory, instruction in the memory, and a general purpose processor that executes the instructions. Estimator 10 may be invoked from various locations, including user interface 12 or terminals on printing systems 2.

Figure 2:
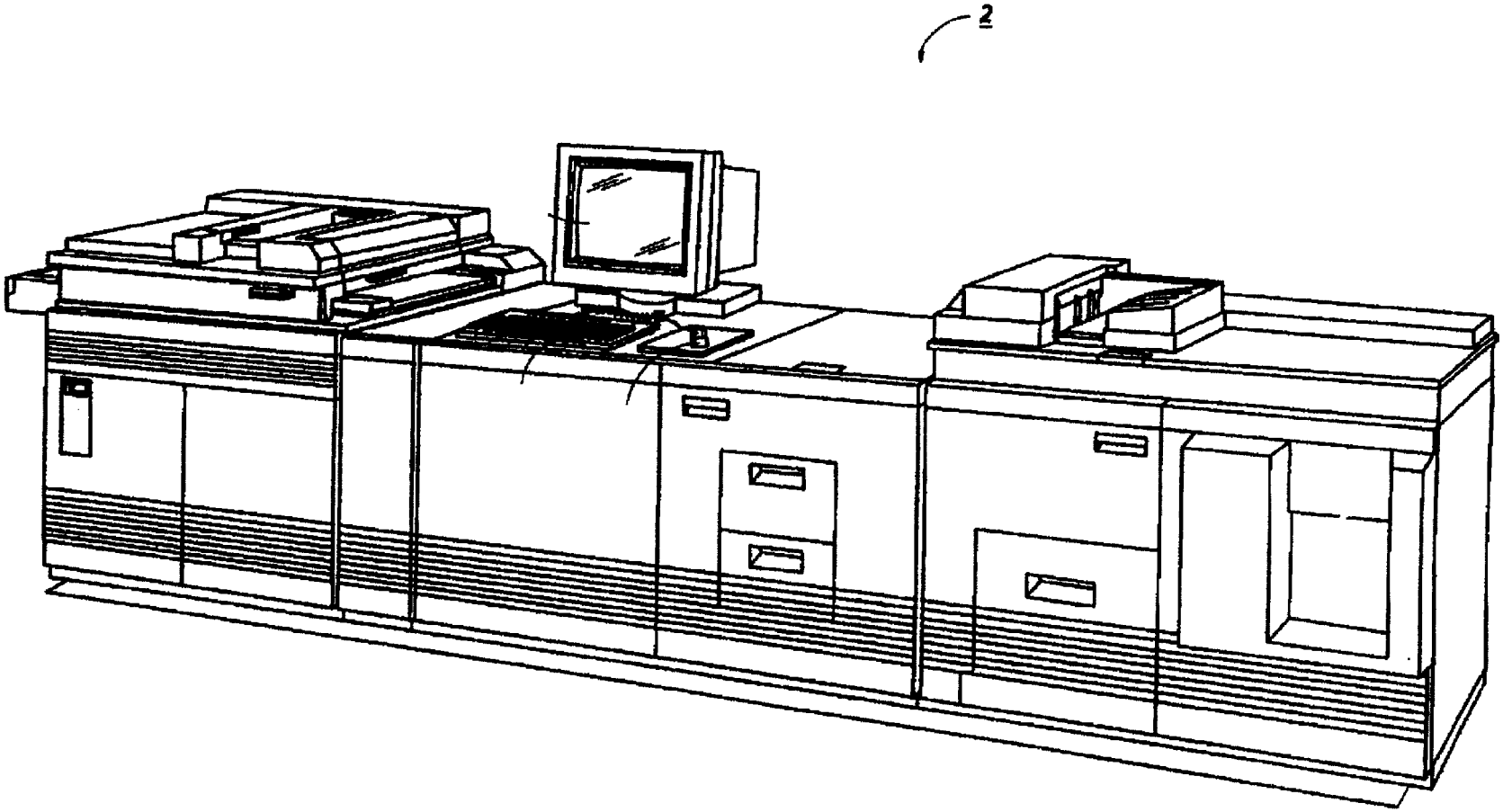
FIG. 2 is a view of one of the printing systems shown in FIG. 1.

FIG. 2 is an example of one of the printing systems 2.

Figure 3:
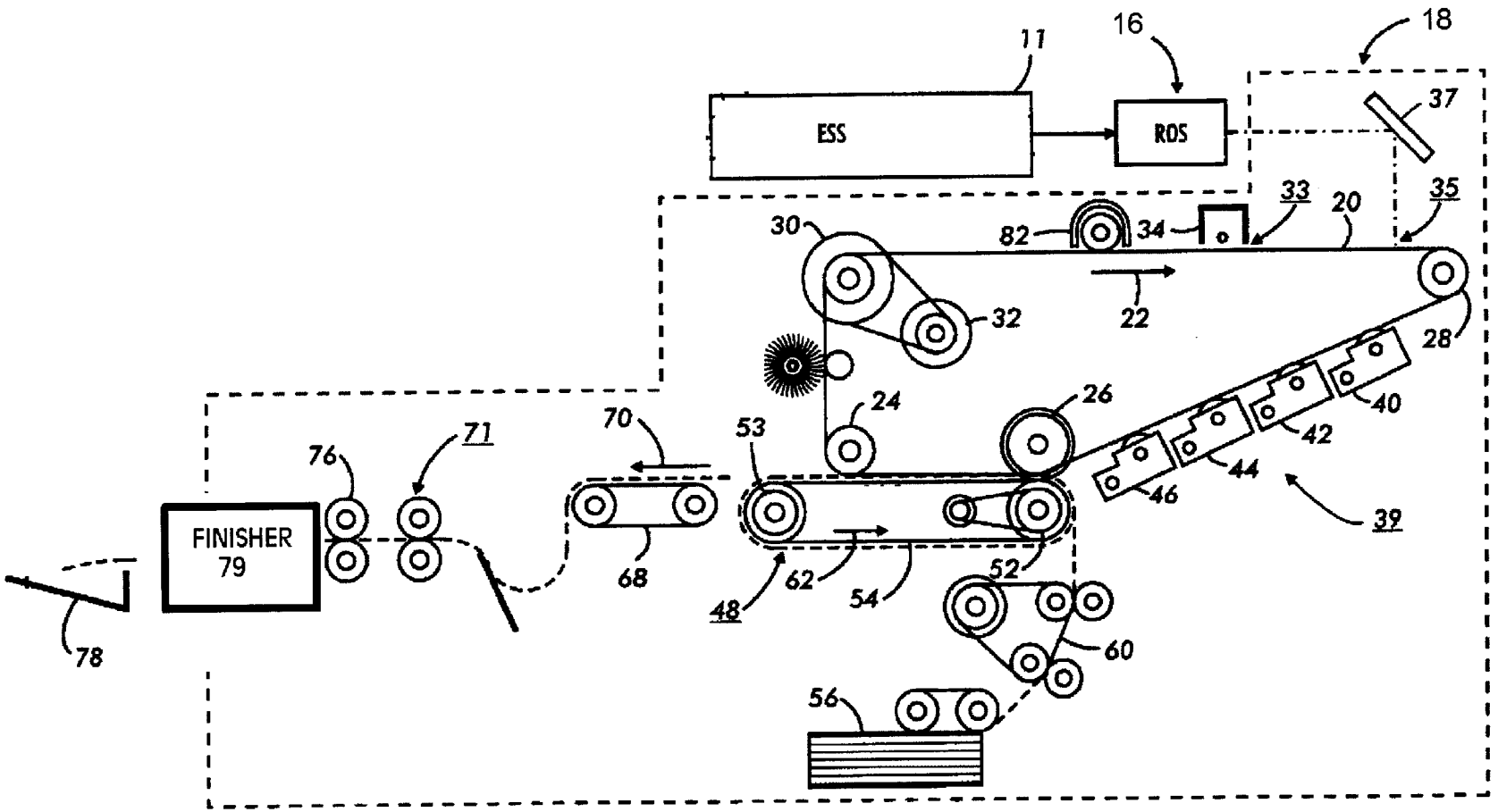
FIG. 3 is a diagram emphasizing certain electromechanical features in the printing system of FIG. 2.

FIG. 3 shows a schematic elevational view emphasizing certain features of printing system 2. Printer 18 includes a color electrophotographic printing machine. Electronic subsystem 11 (ESS) includes data processing and control circuitry to prepare and manage flow of image data to a raster output scanner (ROS) 16. In this Disclosure, the term circuitry encompasses both dedicated hardware and programmable hardware, such as a CPU or reconfigurable logic array, in combination with programming data, such as sequentially fetched CPU instructions or programming data for a reconfigurable array.

Documents transmitted to ESS 11 may also come from a scanner, computer tape, CD ROM, disks, etc.

ESS 11 receives a continuous tone (contone) image and decomposes the contone image to a raster image. ESS 11 transmits signals corresponding to the desired electronic or scanned image to ROS 16 to create the output print image.

ROS 16 preferably includes a laser. ROS 16 illuminates, via mirror 37, the charged portion of a photoconductive belt 20 of printer 18 to achieve a set of subtractive primary latent images. ROS 16 exposes photoconductive belt 20 to record three or four latent images corresponding to the signals transmitted from ESS 11. One latent image is developed with cyan developer material. Another latent image is developed with magenta developer material and the third latent image is developed with yellow developer material. A black latent image may be developed in lieu of, or in addition to, other (colored) latent images. These developed images are transferred to a print sheet in superimposed registration with one another to form a multicolored image on the print sheet.

Photoconductive belt 20 moves in the direction of arrow 22 to advance successive portions of the photoconductive surface sequentially through the various processing stations disposed about the path of movement thereof. Photoconductive belt 20 is entrained about rollers 24, 26, 28, and 30. Motor 32 rotates drive roller 30. As roller 30 rotates, roller 30 advances belt 20 in the direction of arrow 22. Initially, a portion of photoconductive belt 20 passes through a charging station, indicated generally by the reference numeral 33. At charging station 33, a corona generating device 34 charges photoconductive belt 20 to a relatively high, substantially uniform potential. Next, the charged photoconductive surface passes to an exposure station 35. Exposure station 35 receives a modulated light beam that impinges on the surface of photoconductive belt 20. The beam illuminates the charged portion of photoconductive belt 20 to form an electrostatic latent image. The photoconductive belt is exposed three or more times to record three or more latent images thereon.

Developer units 40, 42, 44, and 46, respectively, apply toner particles of a specific color which corresponds to the complement of the specific color separated electrostatic latent image recorded on the photoconductive surface. The color of each of the toner particles absorbs light within a preselected spectral region of the electromagnetic wave spectrum. The charged areas are then made visible by having developer unit 40 apply green absorbing (magenta) toner particles onto the electrostatic latent image recorded on photoconductive belt 20. Similarly, developer unit 42 develops a blue separation with blue absorbing (yellow) toner particles, while the red separation is developed by developer unit 44 with red absorbing (cyan) toner particles. Developer unit 46 contains black toner particles and may be used to develop the electrostatic latent image formed from a black and white document as well as color images.

Each developer units 40, 42, 44, and 46 includes a developer material of magnetizable carrier granules having toner particles adhering triboelectrically thereto. This developer material is constantly moving so as to continually provide the donor with fresh developer material. Development is achieved by bringing the donor of developer material in sufficiently close vicinity of the photoconductive surface.

A sheet transport apparatus 48 moves the sheet into contact with photoconductive belt 20.

As belts 54 move in the direction of arrow 62, the sheet moves into contact with the photoconductive belt, in synchronism with the toner image developed thereon. The sheet remains secured to the sheet gripper so as to move in a recirculating path for three of four cycles. In this way, three or four different color toner images are transferred to the sheet in superimposed registration with one another.

After the last transfer operation, the sheet transport system directs the sheet to a vacuum conveyor 68. Vacuum conveyor 68 transports the sheet, in the direction of arrow 70, to a fusing station, indicated generally by the reference numeral 71, where the transferred toner image is permanently fused to the sheet. Thereafter, the sheet is advanced by a pair of rollers 76 to finisher 79. Finisher 79 includes binding material for fastening multiple sheet together. Sheets processed by finisher 79 then passes to output tray 78 for subsequent removal therefrom by the machine operator.

Additional detail about the mechanical operation of the preferred embodiment of the present invention corresponds to FIG. 3 and accompanying text in Co-owned U.S. Pat. No. 5,850,584, the contents of which are hereby incorporated by reference.

Figure 4:
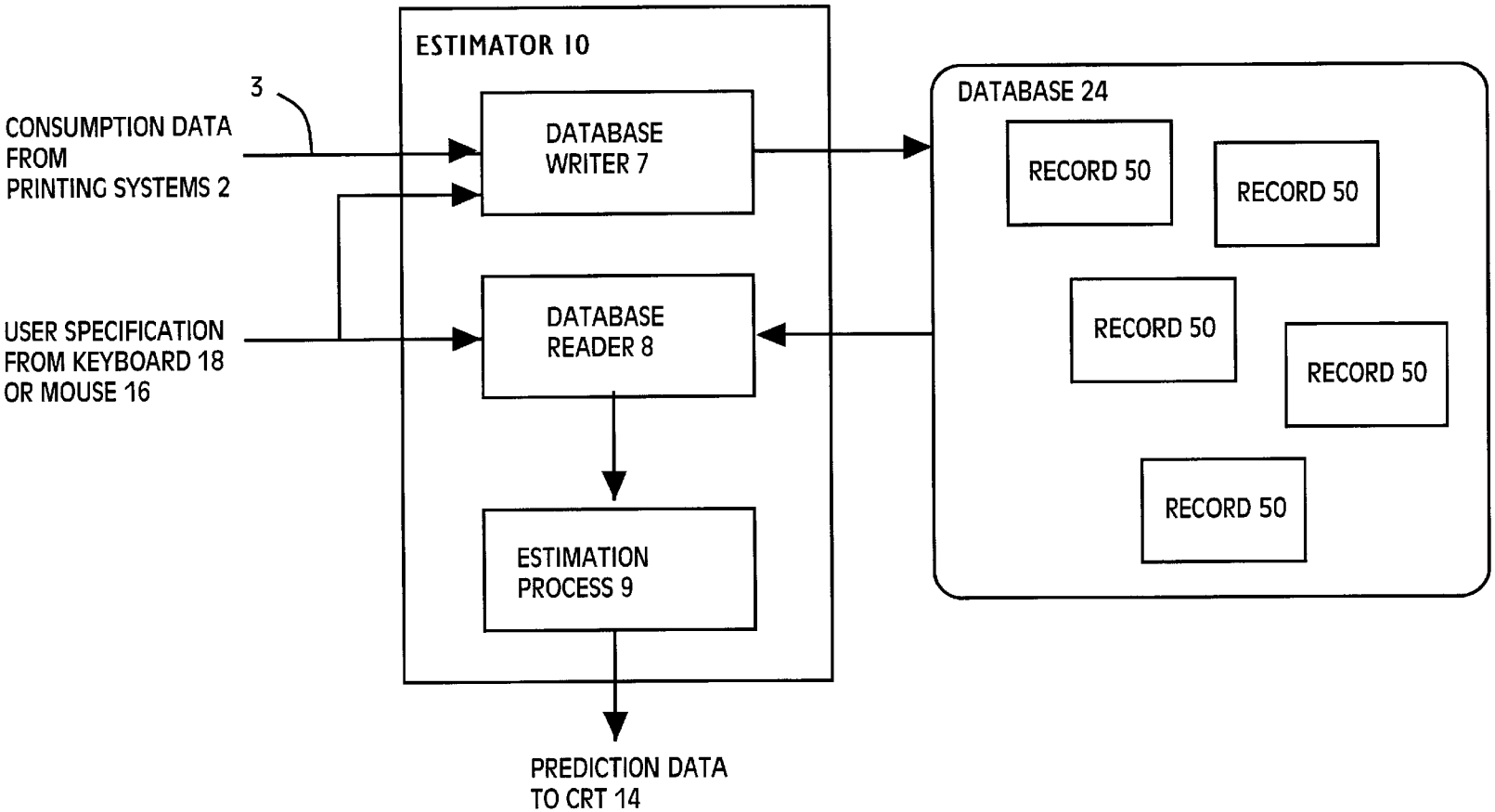
FIG. 4 is a diagram emphasizing a data flow within the preferred system.

FIG. 4 is a diagram emphasizing a data flow within the prediction system. Database 24 includes multiple data structures 50 containing data about previous instances of print jobs. Estimator 10 may be conceptualized as a database writer 7 that constructs records 50 and writes records 50 into database 24, database reader 8 that reads records 50 and selects a record 50 according to criteria, and estimation process 9 that uses a record, selected by database reader 8, to estimate, or predict, consumable resources required to print a future job. User specification from keyboard 18 or mouse 16 may be explicit information about the job, or, for example, may be more indirect information, such as the name of a file containing printing instructions, or "job ticket," information.

Figure 5:
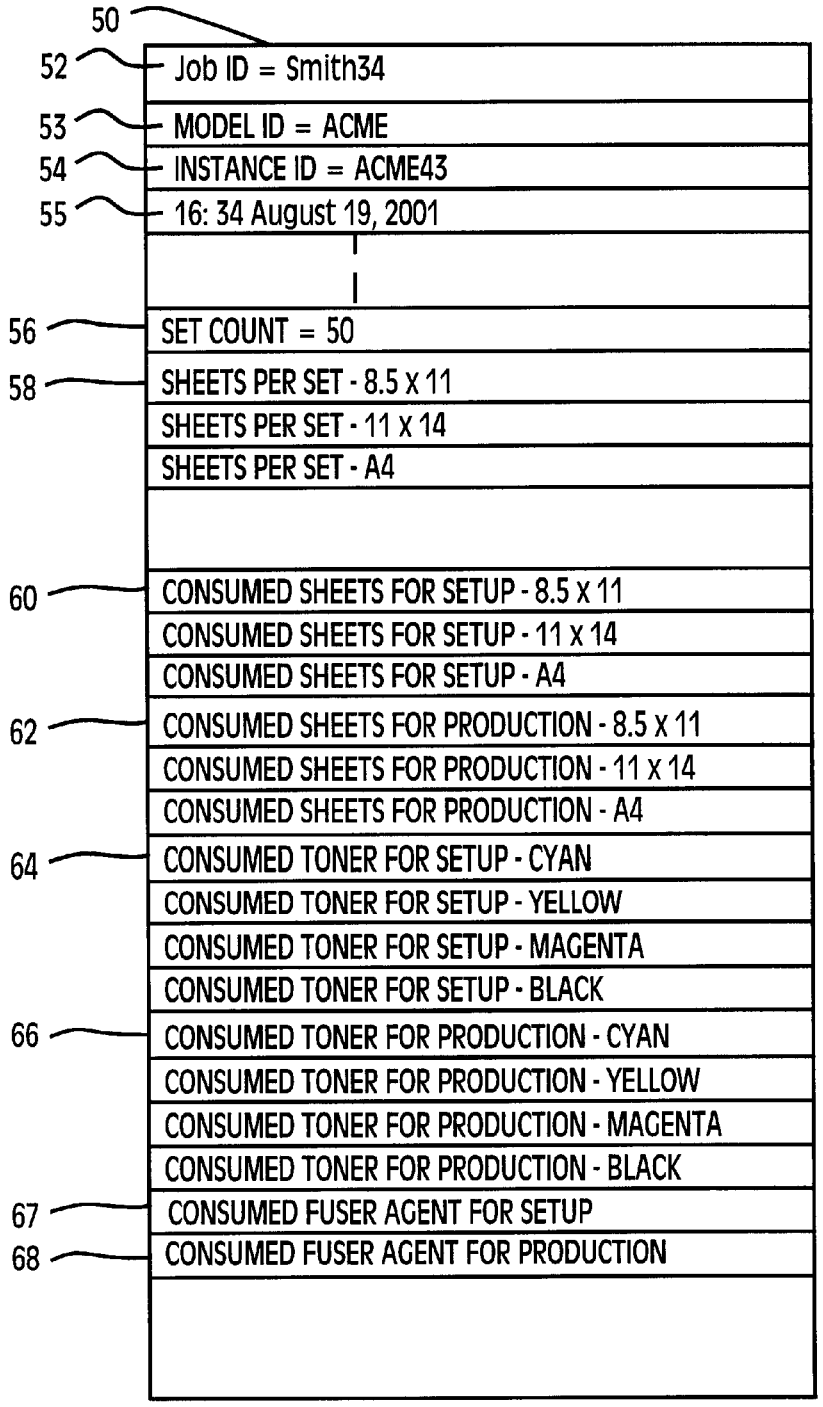
FIG. 5 is a diagram of an instance of a data structure in the preferred system.

FIG. 5 is a diagram showing one of the data structures 50, constructed and written by estimator 10. In addition to the specific examples shown in FIG. 5, a job may be associated with many other types of consumables and other details. For example, sheets may encompass various types of printing substrates including paper, textile, acetate, and other synthetic films.

To construct structure 50, in some situations the operator may have to indicate to the system when the transition from set-up to production occurs. The operator will have to indicate to the system either the number of acceptable sets or the number of sets discarded after the on-line printing and finishing operations are completed.

Figure 6A:
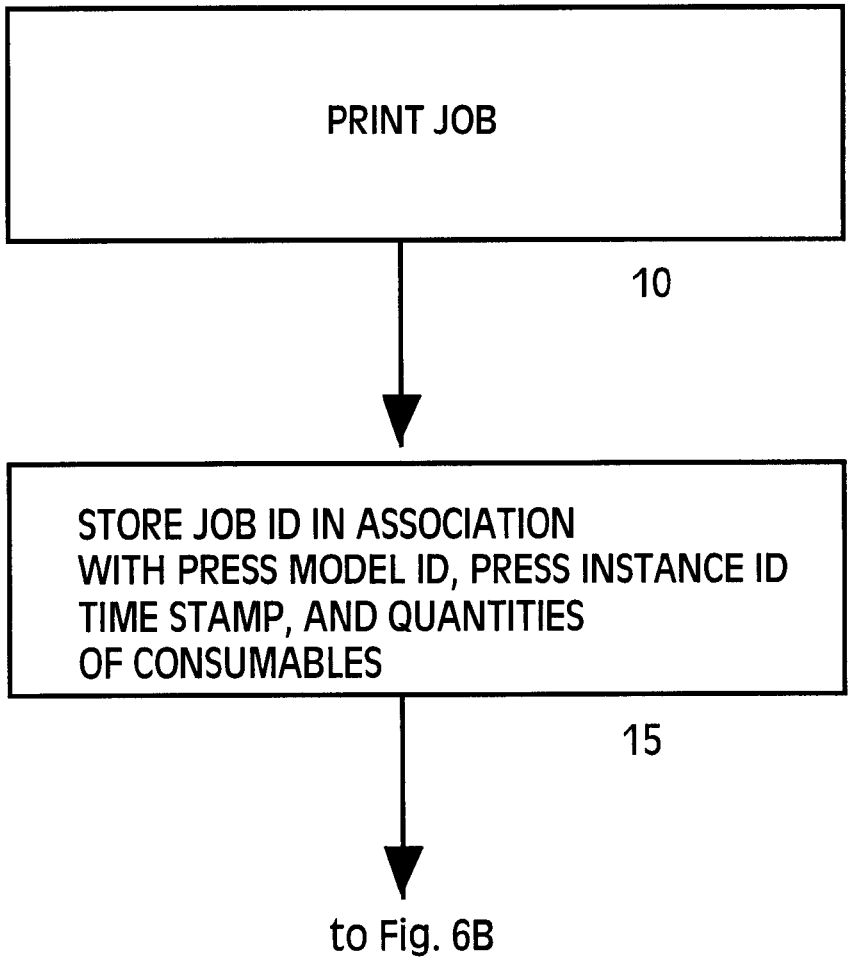
FIGS. 6A, 6B, and 6C are 3 a flow chart showing a process performed in the preferred system.
Figure 6B:
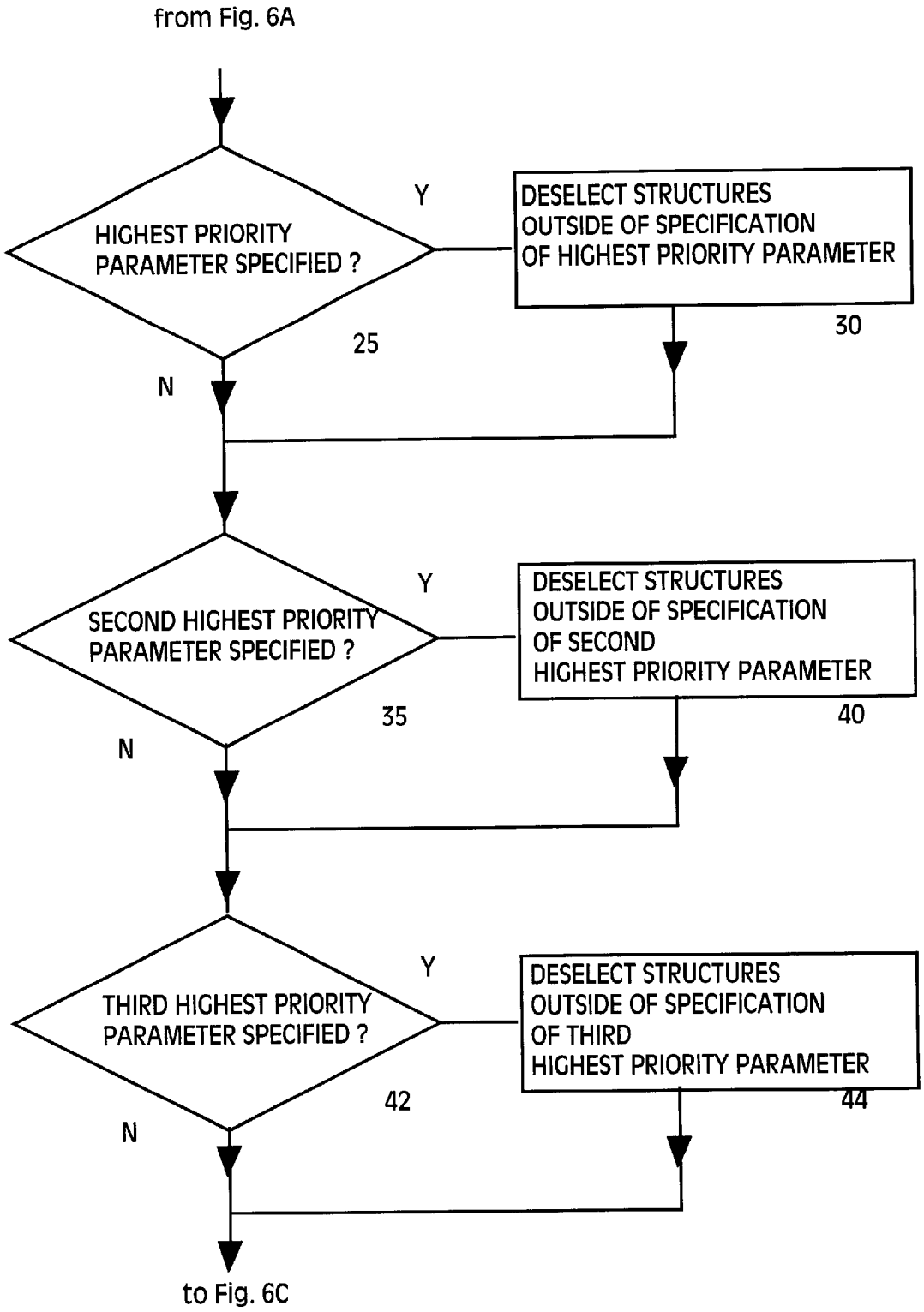
Figure 6C:
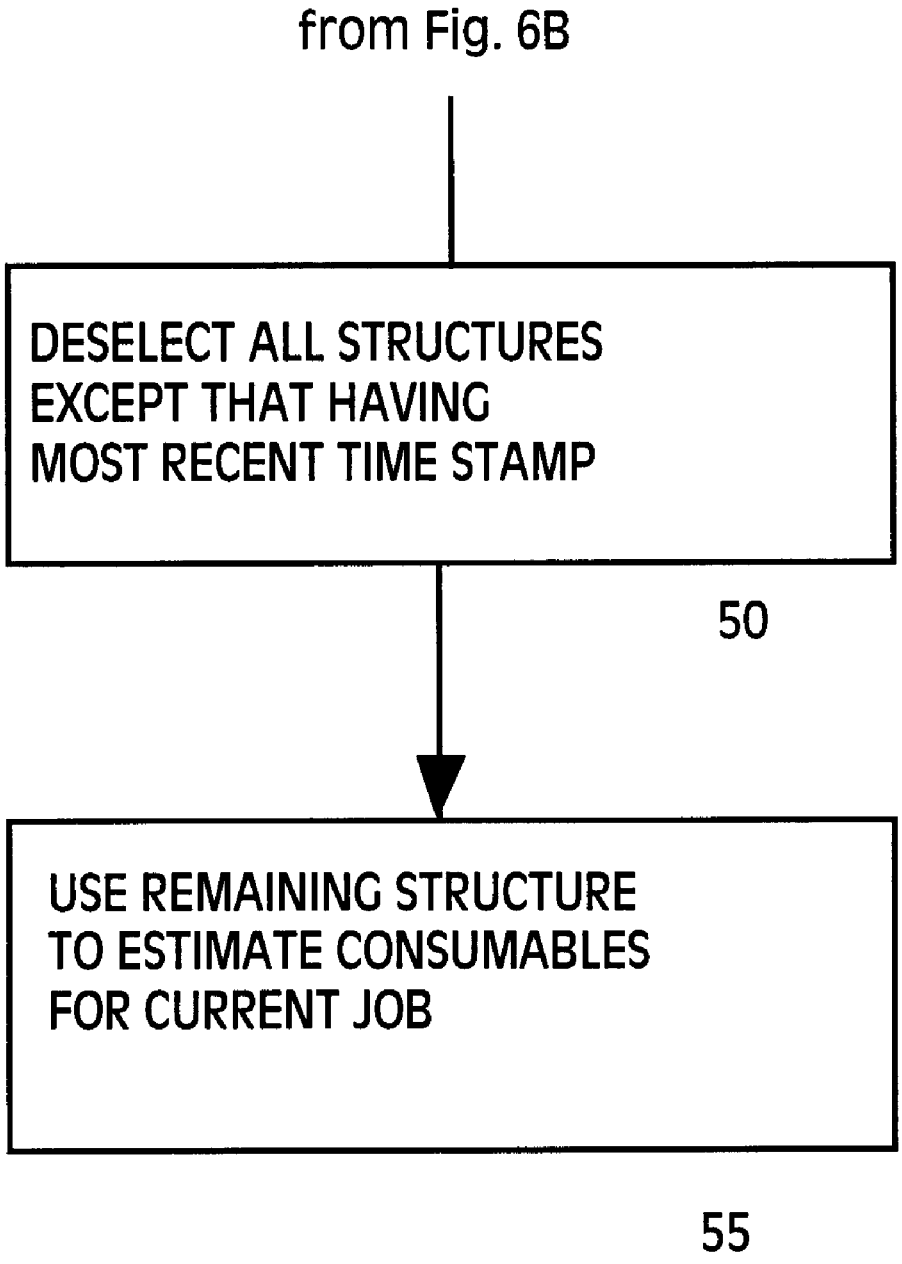

FIGS. 6A, 6B, and 6C are flow charts showing processes performed by system 1. The preferred system prints a job on one of printing systems 2. (step 10). System 1 then constructs and writes a data structure 50 into database 24 on disk 25. The constructed structure 50 includes a job ID field 52 with the ID of the job printed in step 10, a field 53 including the model identifier of the printing system 2 used in step 10, a field 54 including a model instance identifier of the printing system used in step 10, a field 56 including the time of the printing of the job, a field 56 including the number of sets of documents for the job, and various quantities of consumables used to print the job, as shown in structure 50 of FIG. 5. (Step 15).

Subsequently, before printing another job, user 22 may invoke estimator 10 from user interface 12. In response to user input, estimator 10 selects one of the data structures 50, and uses the contents of the selected structure to estimate consumables for the next job. More specifically, the user may specify which properties are most important in selecting which structure 50 estimator 10 will use to estimate the next job. Prior to step 25, essentially all data structures 50 and database 24 are selected. Estimator 10 determines whether the user has selected and entered a highest priority parameter for selection (step 25). If user 22 has specified a highest priority parameter, estimator 10 deselects those data structures 50 that are outside of the specification for the highest priority parameter (step 30).

Estimator 10 determines whether the user has selected and entered a second highest priority parameter for selection (step 35). If user 22 has specified a second highest priority parameter, estimator 10 deselects those data structures 50 that are outside of the specification for the second highest priority parameter (step 40).

Estimator 10 determines whether the user has selected and entered a third highest priority parameter for selection (step 42). If user 22 has specified a third highest priority parameter, estimator 10 deselects those data structures 50 that are outside of the specification for the third highest priority parameter (step 44).

Estimator 10 deselects all remaining structures except one having the most recent time stamp (step 50), and uses the remaining structure 50 to estimate the consumables for the next job (step 55).

Figure 7A:
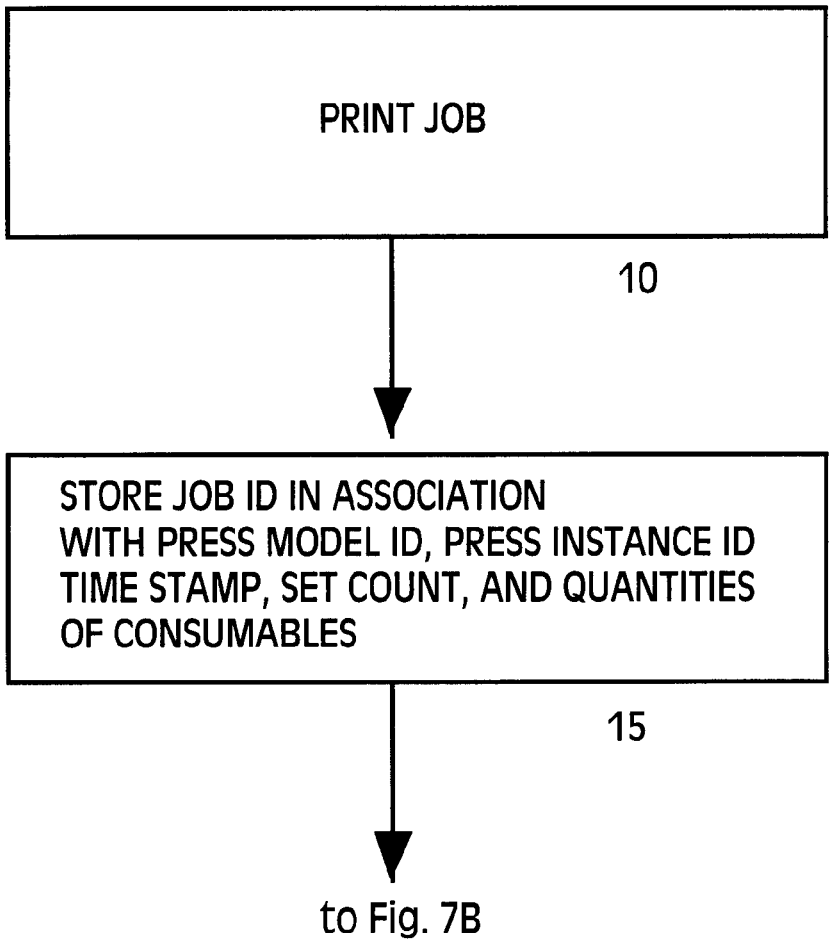
FIGS. 7A, 7B, and 7C are flow charts of more specific instances of processing shown in FIGS. 6A, 6B, and 6C.
Figure 7B:
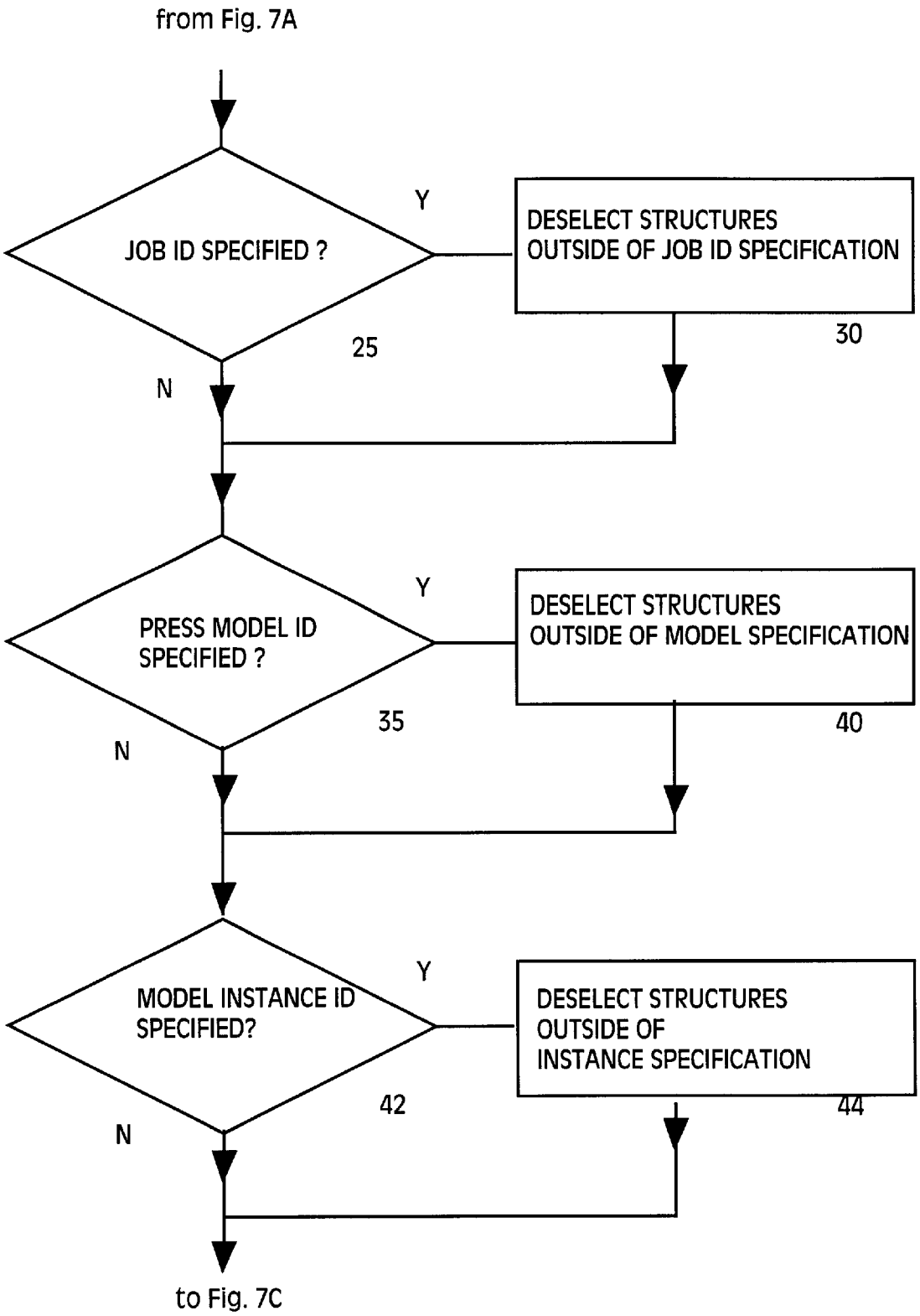
Figure 7C:
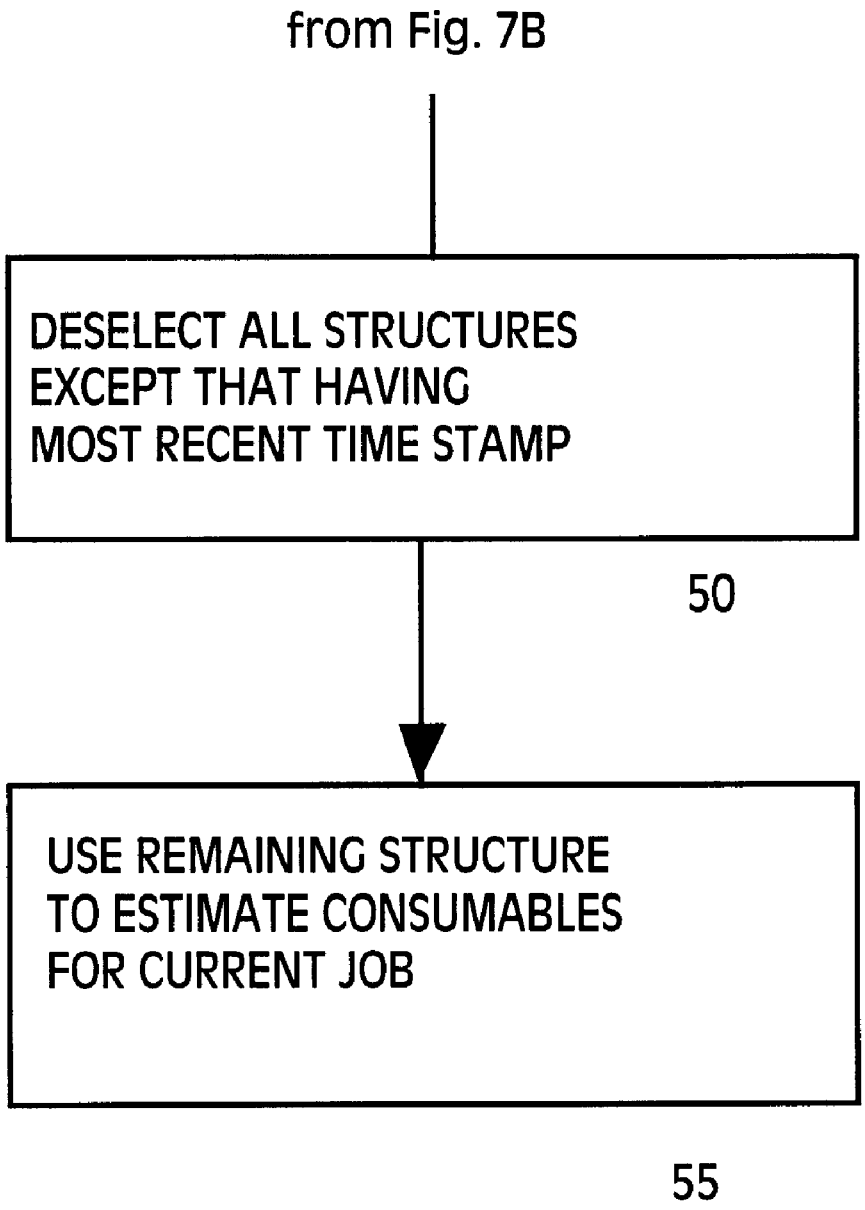

FIGS. 7A, 7B, and 7C are flow charts of more specific instances of processing shown in 6A, 6B, and 6C. The processing of steps 10 and 15 of FIGS. 7A, 7B, and 7C is identical to the processing of steps 10 and 15 of FIGS. 6A, 6B, and 6C. Prior to step 25 of FIGS. 7A, 7B, and 7C, essentially all data structures 50 and database 24 are selected. Estimator 10 determines whether the user has selected and entered a job ID (step 25). If user 22 has specified a Job ID, estimator 10 deselects those data structures 50 that are outside of the specification for job ID (step 30).

Estimator 10 determines whether the user has selected and entered a job ID (step 35). If user 22 has specified a job ID, estimator 10 deselects those data structures 50 that are outside of the specification for the job ID (step 40).

Estimator 10 determines whether the user has selected and entered model instance ID (step 42). If user 22 has specified a model instance ID, estimator 10 deselects those data structures 50 that are outside of the specification for the model instance ID (step 44).

Estimator 10 deselects all remaining structures except one having the most recent time stamp (step 50), and uses the remaining structure 50 to estimate the consumables for the next job (step 55).

Commercially available database search engines may provide some of the low level functionality of the process of FIGS. 7A, 7B, and 7C.

Processing of step 55 includes invocation of a consumable usage model, taking into account the number of pages in the previous job, and the number of acceptable sheets and sets produced in the previous job.

To execute step 55, estimator 10 calculates a consumable, such as toner or fuser agent, necessary to effect the next job. The amount of consumable necessary to effect the next job is the amount of consumable necessary to set-up the production equipment, plus the amount of consumable necessary to produce the production quantity. Estimator 10 calculates the consumable necessary to set-up the production equipment by, for example, scaling the previous job consumable by the ratio of each type of sheet in the current job to corresponding sheets in the previous job. Estimator 10 calculates the consumable necessary to produce the production quantity by, for example, scaling the previous job consumables by the ratio of good sets in the current job to good sets in the previous job.

Figure 8:
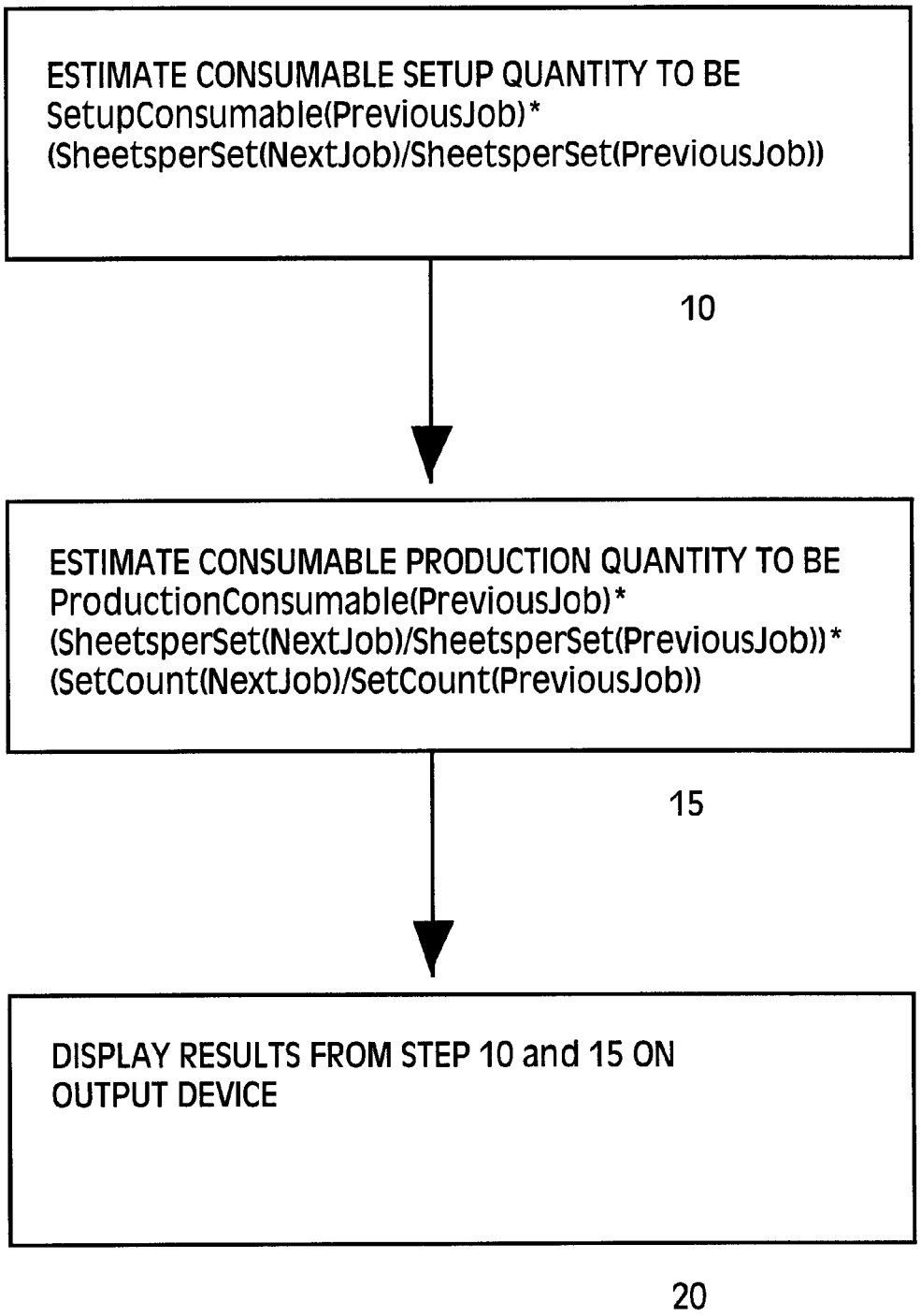
FIG. 8 is a flow chart showing a step of the processing of FIGS. 7A, 7B, 7C in more detail.

FIG. 8 shows a process performed by estimator 10 to execute step 55. Estimator 10 executes the process of FIG. 8 for each one of a group of consumables. For example, estimator 10 executes the process of step 8 to predict an amount of fuser agent that will be consumed on the next job. In step 10, estimator 10 estimates the amount of the consumable that will be required to set up the printing machine for the next job. In step 15, estimator 10 estimates the amount of the consumable that will be required to produce the job. In step 20, estimator 10 displays results from step 10 and 15 on an output device, such as CRT 14. To display results, step 20 may sum the results from steps 10 and 15, for example. "Previous job" represents a record selected by processing of step 50 of FIGS. 7A, 7B, and 7C. "SheetsperSet" yields the total number of sheets in each set, which is the sum of the number of each sheet type. "SetupConsumable" yields the value of the setup field for the consumable currently being estimated. For example, when the processing of FIG. 8 is invoked for fuser agent, setup consumable yields the value of fields 67. "ProductionConsumable" yields the value of the production field for the consumable currently being estimated. For example, when the processing of FIG. 8 is invoked for fuser agent, setup consumable yields the value of fields 68.

During a production run after a prediction for the run, if estimator 10 determines whether it appears that the actual usage will exceed the predicted usage. If it appear that the actual usage will exceed the predicted usage, estimator 10 notifies an operator is notified of a potential consumable shortage. The consumable usage model could be triggered by a control system update of the set quantity from a printing system 2.

In summary, the presently preferred system receives data indicating a first quantity for a first printing of a job when, for example, an operator expresses printing instructions, such as "job ticket," including a job I.D. One of printing systems 2 produces this first quantity. Estimator 10 receives a signal indicating this first quantity. Estimator 10 receives a signal indicating a quantity of a resource, such as fuser agent. Estimator 10 stores these two signals in data structure 50, which defines a type of association between these signals, and stores the thus constructed data structure 50 into database 24 on disk 25.

Subsequently, to estimate consumables needed for another print request, estimator 10 receives a desired quantity of the next print request, and processes data in a selected structure 50 to estimate a quantity of one or more resources needed to produce the next print request.

Thus, a presently preferred printing machine records information about resources expended to carry out a printing request. The recorded resource information may include quantities of particular paper types and colored toner needed to satisfy the printing request. Subsequently, before carrying out another printing request, the printing machine uses the recorded information to make a prediction or estimate of resources required to carry out the printing request. The printing machine thus reduces uncertainty about whether there are sufficient resources to satisfy the next request, and alleviates the burden of maintaining excessive consumables in inventory.

Of course the systems and method described above may optionally be practiced with many other types of systems and methods related to printing. For example, the systems and methods above may optionally be practiced with features described in copending application of DAVID C. ROBINSON and MICHAEL E. FARRELL for SYSTEMS AND METHODS FOR IMAGE REPRODUCTION IN MULTIPLE SESSIONS, filed concurrently with the instant application, the contents of which is herein incorporated by reference.

Additional advantages and modifications will readily occur to those skilled in the art. For example, information about consumables may be stored in alternate types of data structures, including contiguous records, or associated data distributed among separated locations on a storage device or in a network. The invention in its broader aspects is therefore not limited to the specific details, representative apparatus, and illustrative examples shown and described. Accordingly, departures may be made from such details without departing from the spirit or the scope of Applicants' general inventive concept. The invention is defined in the following claims.

What is claimed is:

1. A method comprising:

generating a first signal indicating a quantity of a first set of printed documents;

generating a second signal indicating a quantity of a resource consumed in producing the quantity of the first set;

storing the first and second signals;

receiving a third signal indicating a desired quantity of a second set of printed documents; and estimating a quantity of the resource needed to effect the desired quantity of the second set, the estimating depending on the first, second, and third signals.

2. The method of claim 1 wherein estimating includes determining a ratio of the third signal to the first signal.

3. The method of claim 1 wherein the resource is a printing substrate.

4. The method of claim 1 wherein the resource is pigment.

5. The method of claim 1 wherein the resource is fuser agent.

6. The method of claim 1 wherein estimating includes estimating respective quantities of a plurality of resources needed to effect the desired quantity.

7. The method of claim 1 wherein estimating includes estimating respective quantities of a plurality of resources needed to effect the desired quantity, the plurality of resources including a printing substrate, and a pigment.

8. The method of claim 1 wherein estimating includes estimating respective quantities of a plurality of resources needed to effect the desired quantity, the plurality of resources including a printing substrate, a first pigment of a first color, and a pigment of a second color.

9. The method of claim 1 further including storing the first and second signals in association with a job identifier.

10. The method of claim 1 wherein the producing, generating, and storing steps are performed a plurality of times, and each performance of the storing step stores in association with a first job identifier, the method further includes receiving a second job identifier, and estimating includes estimating using the second signal stored in association with a first job identifier corresponding to the second job identifier.

11. The method of claim 10 wherein estimating includes estimating using the second signal stored in association with a first job identifier that is equal to the second job identifier.

12. The method of claim 1 further including storing the first and second signals in association with a machine identifier.

13. The method of claim 1 wherein the producing, generating, and storing steps are performed a plurality of times, and each performance of the storing step stores in association with a first machine identifier, the method further includes receiving a second machine identifier to identify a machine to be used to effect the second set, and estimating includes estimating using the second signal stored in association with a first machine identifier corresponding to the second machine identifier.

14. The method of claim 13 wherein estimating includes estimating using the second signal stored in association with a first machine identifier equal to the second machine identifier.

15. The method of claim 1 further including storing the first and second signals in association with a time.

16. The method of claim 1 wherein the producing, generating, and storing steps are performed a plurality of times, and each performance of the storing step stores in association with a respective time, and estimating includes estimating using the second signal stored in association with a most recent time.

17. The method of claim 1 further including receiving a first page count indicating a number of pages in the first set;

generating a fourth signal indicating a quantity of the resource consumed before complete production of the first set;

storing the fourth signal;

receiving a second page count indicating a number of pages in the second set, wherein estimating includes estimating depending on the fourth signal and a relation of the second page count to the first page count.

18. The method of claim 14 wherein estimating includes estimating depending on the fourth signal and a ratio of the second page count to the first page count.

19. system comprising:

a generator that generates an associating signal associating a first signal indicating a quantity of a first set of printed documents, with a second signal indicating a quantity of a resource consumed in producing the quantity of the first set;

a memory that stores the associating signal;

receiver that receives a third signal indicating a desired quantity of a second set of printed documents; and an estimator that estimates a quantity of the resource needed to effect the desired quantity of the second set, the estimating depending on the first, second, and third signals.

20. The system of claim 19 wherein the estimator includes circuitry that determines a ratio of the third signal to the first signal.

21. The system of claim 19 wherein the resource is a printing substrate.

22. The system of claim 19 wherein the resource is pigment.

23. The system of claim 19 wherein the resource is fuser agent.

24. The system of claim 19 wherein the estimator includes circuitry that estimates respective quantities of a plurality of resources needed to effect the desired quantity.

25. The system of claim 19 wherein the estimator includes circuitry that estimates respective quantities of a plurality of resources needed to effect the desired quantity, the plurality of resources including a printing substrate, and a pigment.

26. The system of claim 19 wherein the estimator includes circuitry that estimates respective quantities of a plurality of resources needed to effect the desired quantity, the plurality of resources including a printing substrate, a first pigment of a first color, and a pigment of a second color.

27. The system of claim 19 further including a data structure that associates the first and second signals with a job identifier.

28. The system of claim 27 wherein the receiver includes circuitry that receives a second job identifier.

29. The system of claim 28 wherein the estimator includes circuitry that estimates using the second signal stored in association with a first job identifier that is equal to the second job identifier.

30. The system of claim 19 further including a data structure that associates the first and second signals with a machine identifier.

31. The system of claim 19 wherein the receiver includes circuitry that receives a second machine identifier to identify a machine to be used to effect the second set.

32. The system of claim 31 wherein estimating includes estimating using the second signal stored in association with a first machine identifier that is equal to the second machine identifier.

33. The system of claim 19 further including a data structure that associates the first and second signals with a time.

34. A system comprising:

means for receiving a first signal indicating a quantity of a first set of printed documents;

means for generating a second signal indicating a quantity of a resource consumed in producing the quantity of the first set;

means for storing the first and second signals;

means for receiving a third signal indicating a desired quantity of a second set of printed documents; and means for estimating a quantity of the resource needed to effect the desired quantity of the second set, the estimating depending on the first, second, and third signals.

35. The system of claim 34 wherein the means for estimating includes circuitry that determines a ratio of the third signal to the first signal.

36. The system of claim 34 wherein the resource is a printing substrate.

37. The system of claim 34 wherein the resource is pigment.

38. The system of claim 34 wherein the resource is fuser agent.

39. The system of claim 34 wherein the means for estimating includes circuitry that estimates respective quantities of a plurality of resources needed to effect the desired quantity.

40. The system of claim 34 wherein the means for estimating includes circuitry that estimates respective quantities of a plurality of resources needed to effect the desired quantity, the plurality of resources including a printing substrate, and a pigment.

41. The system of claim 34 wherein the means for estimating includes circuitry that estimates respective quantities of a plurality of resources needed to effect the desired quantity, the plurality of resources including a printing substrate, a first pigment of a first color, and a pigment of a second color.

42. The system of claim 34 further including a data structure that associates the first and second signals with a job identifier.

43. The system of claim 34 wherein the means for receiving includes circuitry that receives a second job identifier.

44. The system of claim 43 wherein estimating includes estimating using the second signal stored in association with a first job identifier equal to the second job identifier.

45. The system of claim 34 further including a data structure that associates the first and second signals with a machine identifier.

46. The system of claim 34 wherein the means for receiving includes circuitry that receives a second machine identifier to identify a machine to be used to effect the second set.

47. The system of claim 46 wherein the means for estimating includes circuitry that estimates using the second signal stored in association with a first machine identifier that is equal to the second machine identifier.

48. The system of claim 34 further including a data structure that associates the first and second signals in association with a time.

* * * * *